US007425025B2

(12) United States Patent
Barlow, Jr.

(10) Patent No.: US 7,425,025 B2
(45) Date of Patent: Sep. 16, 2008

(54) RECESSED DOOR LOCK ACTUATOR ASSEMBLY FOR A VEHICLE

(75) Inventor: John Barlow, Jr., Raymond, OH (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/671,678

(22) Filed: Feb. 6, 2007

(65) Prior Publication Data

US 2007/0138808 A1 Jun. 21, 2007

Related U.S. Application Data

(62) Division of application No. 10/992,263, filed on Nov. 18, 2004, now Pat. No. 7,204,529.

(51) Int. Cl.
*E05C 17/04* (2006.01)
*E05B 3/00* (2006.01)

(52) U.S. Cl. ..... 292/262; 292/336.3

(58) Field of Classification Search ..... 292/336.3, 292/262

See application file for complete search history.

(56) References Cited

U.S. PATENT DOCUMENTS

| | | | | |
|---|---|---|---|---|
| 3,784,242 | A * | 1/1974 | Hill | 292/336.3 |
| 4,205,868 | A * | 6/1980 | Kurth | 292/347 |
| 4,606,567 | A * | 8/1986 | Kato et al. | 292/336.3 |
| 4,674,780 | A | 6/1987 | Weinerman et al. | |
| 4,813,727 | A | 3/1989 | Mills | |
| 4,842,312 | A | 6/1989 | Iwasaki et al. | |
| 4,895,400 | A * | 1/1990 | Harding et al. | 292/145 |
| 5,056,343 | A | 10/1991 | Kleefeldt et al. | |
| 5,088,781 | A | 2/1992 | Ono et al. | |
| 5,497,640 | A | 3/1996 | Kokuryo | |
| 5,634,676 | A * | 6/1997 | Feder | 292/201 |
| 5,794,995 | A | 8/1998 | Creesy et al. | |
| 5,974,842 | A | 11/1999 | Schlack et al. | |
| D435,003 | S | 12/2000 | Tsay | |
| 6,698,262 | B2 | 3/2004 | Wittwer | |
| D489,304 | S | 5/2004 | Schowalter et al. | |
| 2003/0116455 | A1 * | 6/2003 | Marsilio et al. | 206/308.2 |

* cited by examiner

*Primary Examiner*—Patricia Engle
*Assistant Examiner*—Kristina R Fulton
(74) *Attorney, Agent, or Firm*—Carrier, Blackman & Associates, P.C.; William D. Blackman; Joseph P. Carrier

(57) ABSTRACT

A lock actuator assembly for a locking mechanism of a vehicle door permits either manual or power actuation thereof. The lock actuator assembly includes a housing having a pair of brackets attached thereto, an actuator slidably secured within the housing, and a solenoid disposed below the housing and operatively attached to the actuator. The solenoid is operable to move the actuator between a locked position in which the locking mechanism is locked, and an unlocked position in which the locking mechanism is unlocked. The housing of the lock actuator assembly defines a first plane and the actuator defines a second plane which is substantially parallel to the first plane.

13 Claims, 6 Drawing Sheets

RECESSED DOOR LOCK ACTUATOR ASSEMBLY FOR A VEHICLE

CROSS-REFERENCE TO RELATED APPLICATIONS

The present application is a divisional application of U.S. patent application Ser. No. 10/992,263, having a filing date of Nov. 18, 2004, now issued as U.S. Pat. No. 7,204,529. The subject matter of the prior U.S. application Ser. No. 10/992,263 is incorporated by reference herein.

BACKGROUND OF THE INVENTION

1. Field of the Invention

The present invention relates to vehicle door locking assemblies, and specifically relates to a manually operable lock actuator assembly for a vehicle door lock mechanism. The actuator assembly hereof is operable to selectively lock or unlock the vehicle door from the interior of the vehicle, and is also compatible with power operation, but resists unauthorized access from the exterior of the vehicle using theft devices.

2. Description of the Background Art

Vehicle doors must be lockable from both the interior and the exterior of the vehicle, in order to safeguard the vehicle and its contents. In earlier vehicles, doors have conventionally been made manually lockable and unlockable from the interior of the vehicle, using a high-profile knob provided on the interior door panel sill.

Although older manually actuated mechanisms are well known, the associated door lock knobs, as traditionally employed, are provided having a high profile relative to the door panel sill to promote easy manipulation by the occupant. Unfortunately, such interior door lock knobs are also easily manipulated from the vehicle exterior, and are thus susceptible to unauthorized access, which may lead to theft of the vehicle and/or its contents.

More recently, in an effort to improve convenience and to discourage theft, electronic, or power, door locking systems have become quite popular. Power door locking systems are usually accessed from the interior using a simple door-mounted switch. Many power systems today also use a remote control key fob module, usable to remotely lock or unlock the vehicle.

These electronic systems can actuate the locking assemblies for all vehicle doors simultaneously, and are widely used because of their ease of use and convenience. In addition, they have the practical benefit of deterring theft, since the associated control switches are not easily manually manipulated from the exterior of the vehicle, using traditional theft tools such as wires inserted past the window glass.

However, when the only way of actuating a vehicle's locking mechanism is electronically controlled, there is a risk that an occupant could become trapped within the vehicle, in a situation when there is a failure of the electronic door locking system. Such a failure can occur due to a dead battery, vehicle damage resulting from an accident, or simple electronic malfunction.

A manually actuatable mechanism which is accessible from the vehicle interior is needed, to allow an occupant to access the door lock mechanism in situations when the electronic door switch is not functioning. Ideally, such a manually operable switch would incorporate anti-theft features, to resist unauthorized access using common theft devices.

SUMMARY OF THE INVENTION

The present invention provides a lock actuation assembly for use in actuating a vehicle door lock. The lock actuation assembly may be both manually and electrically operable. The actuation assembly hereof is accessible from the interior of a vehicle, and allows easy manual manipulation of the door locking assembly, even if the vehicle has completely lost power. The inventive lock actuation assembly includes an actuator (lock button) arranged within a recessed housing.

The lock actuation assembly according to an illustrative embodiment of the invention provides an improved theft-resistant door lock actuator structure for a vehicle, in which mechanical operation of the door lock is effectively maintained. The lock actuator button and the related door garnish insert, or housing, in which the actuator is nestingly situated are carefully structured according to the present invention. In a selected illustrative embodiment hereof, the housing is provided to be mounted on an upper edge or sill portion of the interior door panel. The actuator is designed to be oriented flush with, or slightly below the interior door panel sill, when the vehicle is locked.

In a first embodiment of the invention, the housing has a generally rectangular outline shape, with an upper surface which may be tapered or otherwise shaped to conform to the contour of the interior door panel sill for which the assembly is designed.

Also in the first embodiment, the housing is formed with a hollow recess therein. The recess has a generally hourglass shape, and opens upwardly. The actuator is adapted to be positioned in the center of the recess, and a central part of the housing extends inwardly on both sides of the actuator, to form blocking bosses which are situated in close proximity to, and which closely surround opposed side portions of the actuator button.

This structure makes it difficult for a theft device such as a wire, which has been inserted through the window, to operably connect with the actuator. At the same time, the recess is provided with expanded portions on two sides of the actuator, to allow manual manipulation of the actuator by an occupant's fingers, thereby providing a means by which the vehicle is capable of being manually locked or unlocked. This manual operation of the lock works even if the vehicle has completely lost power.

In another embodiment of the invention, the housing may include two spring-loaded finger access panels that overlie the expanded portion of the recess on each side of the actuator. These panels are pivotally connected to outer edge portions of the housing. When the actuator is not being used, the panels are oriented substantially horizontally and perpendicular to the actuator, so as to lie within the plane of the upper surface of the housing.

When the vehicle occupant wishes to unlock the door with this second embodiment, the spring force supporting the panels can be easily overcome. The occupant's fingertips pivotally displace the panels downward into the recess, so as to grasp the knob. The purpose of the access panels, where used, is to prevent a lock picking tool, such as a wire, from gaining access to the collar of the actuator in an attempt to unlock the door to enter the vehicle.

In yet another embodiment of the invention, the actuator is generally plate-shaped and is supported on the underside of the housing in a manner which allows the actuator to slide generally parallel to the housing. In this third embodiment, the housing includes an open frame through which the actuator can be accessed. A concavity, or depression, is formed on the upper surface of the actuator. The concavity is sized to allow a fingertip to be inserted therein to allow manual positioning of the actuator relative to the housing. This configuration provides no protrusions which can be grasped using theft tools. The upper surface of the actuator is also provided with a visual indicator which allows the occupant to determine whether or not the vehicle door is locked.

In all embodiments, the inventive manual lock actuation assembly provides for manual actuation of the door lock mechanism from the interior of the vehicle. In all embodiments, a portion of the manual lock actuation assembly is recessed into the interior door panel. In all embodiments, when the actuator is in the locked position, the top edge of the actuator does not protrude above the upper surface of the housing, which generally conforms to the height of the interior door panel sill. Instead, the top edge of the actuator is flush with or below the upper surface of the housing. In all embodiments, the interrelationship between the actuator structure and the housing structure restricts access to the assembly by theft tools.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF THE INVENTION

Figure 1:
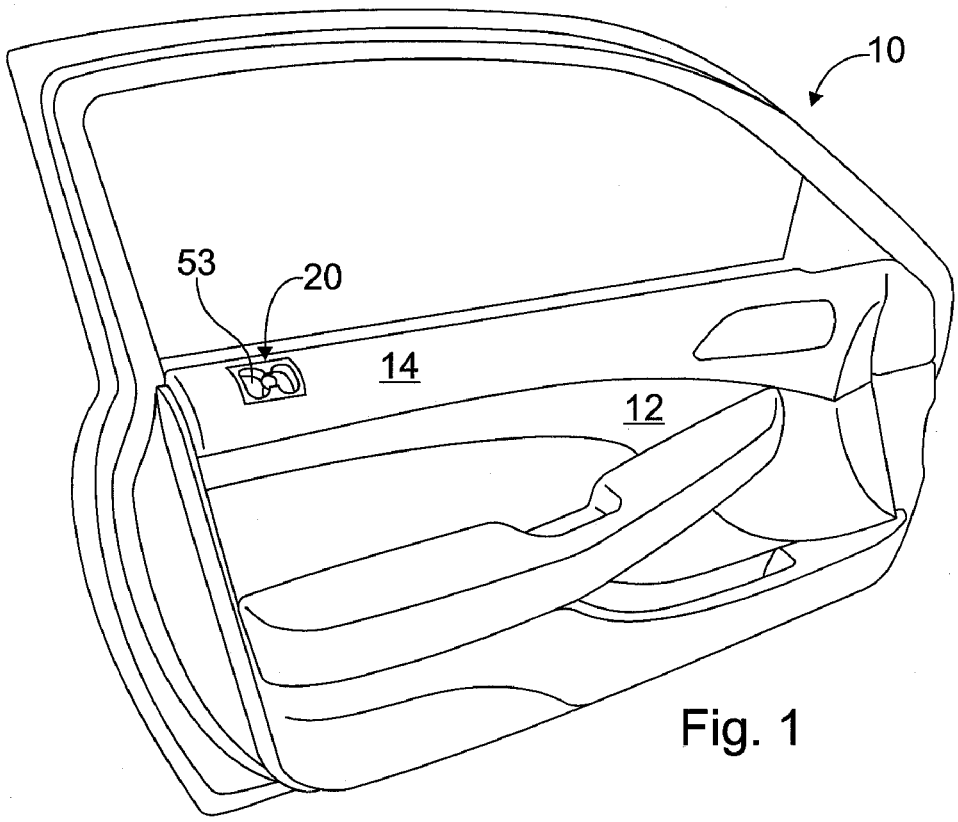
FIG. 1 is an environmental perspective view of an interior door panel for a vehicle illustrating a first embodiment of the recessed lock actuator mounted within the door panel sill.

A number of selected illustrative embodiments of the recessed lock actuator assembly hereof will now be described, with respect to the drawing figures. It should be understood that only structures considered necessary for clarifying the present invention are described herein. Other conventional structures, and those of ancillary and auxiliary components of the system, are assumed to be known and understood by those skilled in the art.

Referring now to FIGS. 1-4, a lock actuator assembly 20, according to a first embodiment of the present invention, is shown mounted within the sill 14 of an interior door panel 12 of a vehicle door 10. The lock actuator assembly 20 includes an actuator, or lock knob, 30 and a housing garnish or housing 50, having a hollow recess 53 formed therein. The upper portion of the actuator 30 is situated within the recess 53 of the housing 50, as shown. The housing 50 has an opening 70 formed in a central portion of the floor 68 thereof, and the upper portion of the actuator 30 extends through the opening 70, to reside in the housing recess 53.

Figure 4:
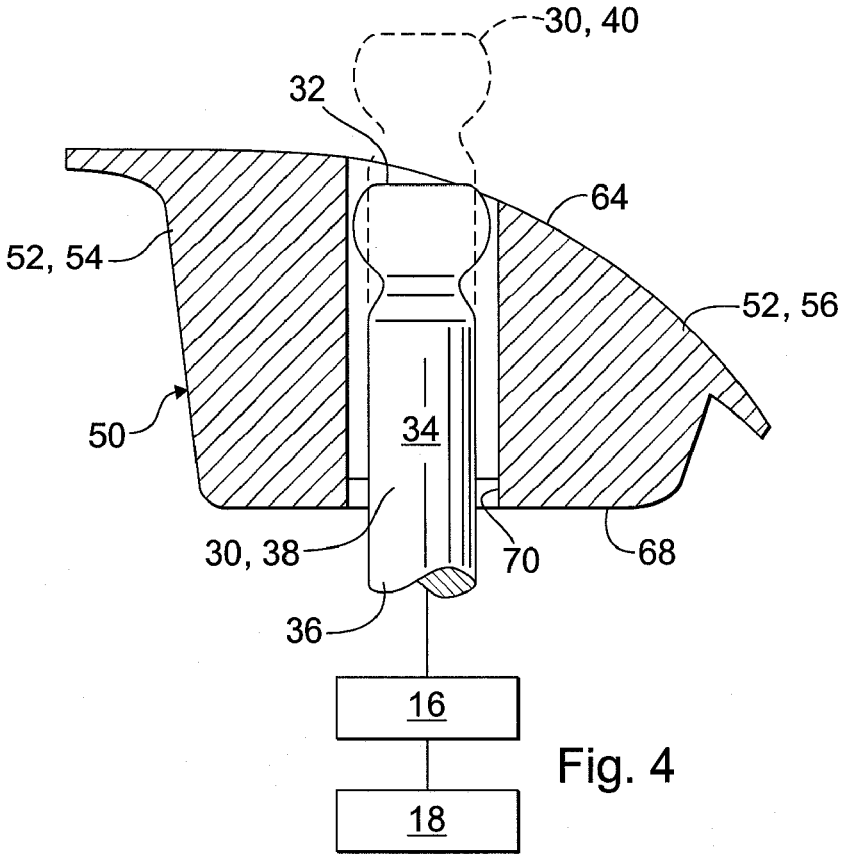
FIG. 4 is a side sectional view of the first embodiment of a recessed lock actuator assembly as seen across line 4-4 of FIG. 2, showing the actuator in a locked position (solid lines) and an unlocked position (broken lines).

The lower end 36 of the actuator 30 is operatively connected to a linkage of the vehicle door locking mechanism 18 (FIG. 4). The actuator 30 is also operatively connected to an electronically operable solenoid 16, to enable power door lock operation.

Figure 3:
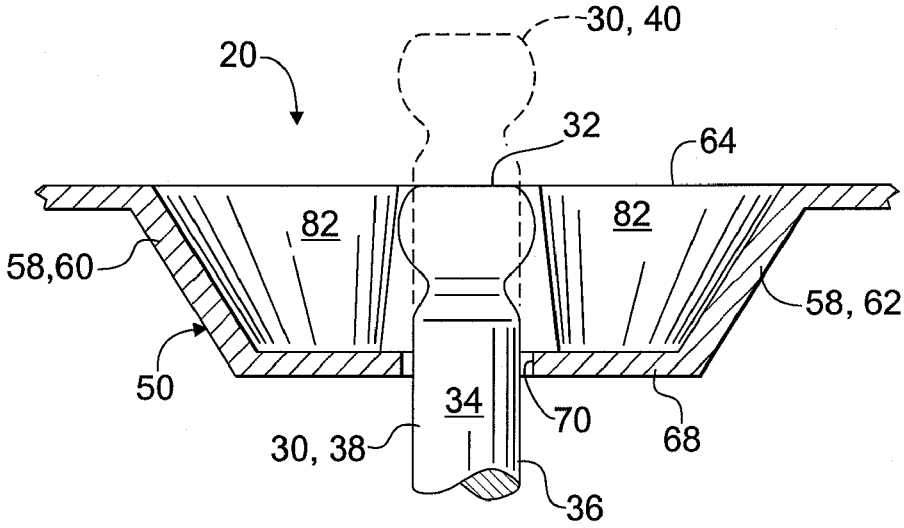
FIG. 3 is a side sectional view of the first embodiment of a recessed lock actuator assembly as seen across line 3-3 of FIG. 2, showing the actuator in a locked position (solid lines) and an unlocked position (broken lines).

The actuator 30 is positionable within the housing 50 between a first, locked position 38 in which the associated door locking mechanism is locked (solid lines, FIGS. 3 and 4), and a second, unlocked position 40 in which the associated door locking mechanism is unlocked (broken lines, FIGS. 3 and 4).

The housing 50 includes side walls 51 and a floor 68 configured to surround and define the recess 53. In the embodiment depicted in FIGS. 1-4, the housing 50 has a rectangular outline shape. However, it is within the scope of this invention to form the housing 50 having alternative shapes, such as square, oval, free-form, or other selected shape. The recess 53 has an open upper end 64 and a closed lower end formed by the floor 68.

The housing 50 resides substantially within an opening formed in the sill 14, such that the upper end 64 of the side walls 51 is generally continuous with, or raised slightly above the surface of the sill 14. The upper end 64 of the side walls 51 define the contour of the upper surface of the housing 50, and may be provided with trim (not shown) for functional, decorative or other purposes.

First Embodiment

Figure 5:
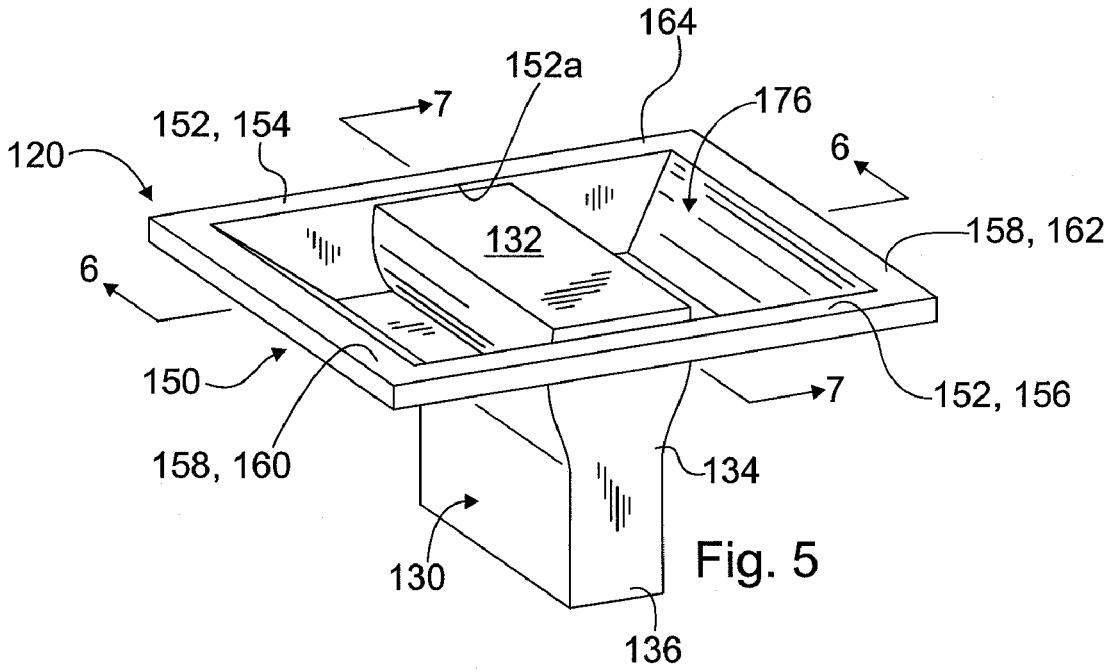
FIG. 5 is a perspective view of a second embodiment of the recessed lock actuator assembly illustrating a housing with a planar upper surface and an actuator, shown in the locked position, that is rectangular in section.
Figure 6:
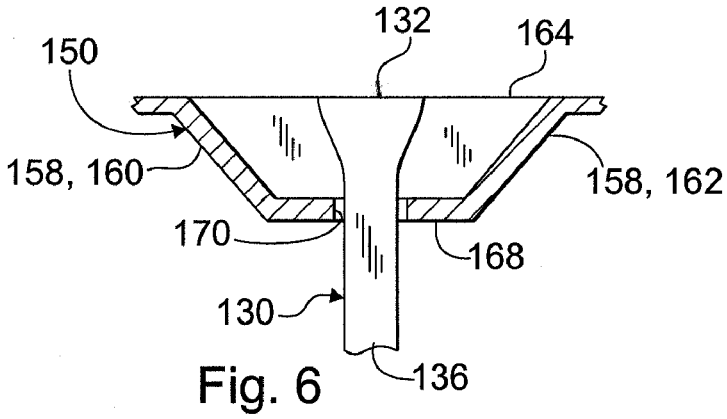
FIG. 6 is a side sectional view of the second embodiment of a recessed lock actuator assembly as seen across line 6-6 of FIG. 5.
Figure 7:
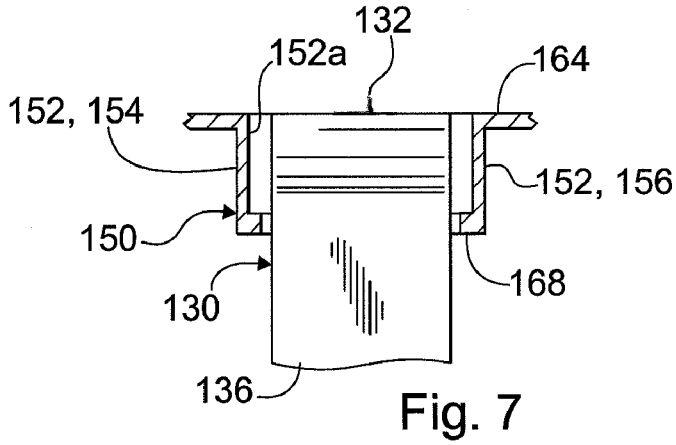
FIG. 7 is a side sectional view of the second embodiment of a recessed lock actuator assembly as seen across line 7-7 of FIG. 5.

In the first embodiment of the lock actuator assembly 20, the housing 50 is provided with a curved upper surface (FIG. 4), to conform to the rounded edge of the door sill 14. It is within the scope of this invention, however, to provide a housing in which the upper surface is not curved. For example, the second embodiment of the lock actuator assembly 120, described below with respect to FIGS. 5-7, illustrates a housing 150 having an upper surface that is substantially flat.

Figure 2:
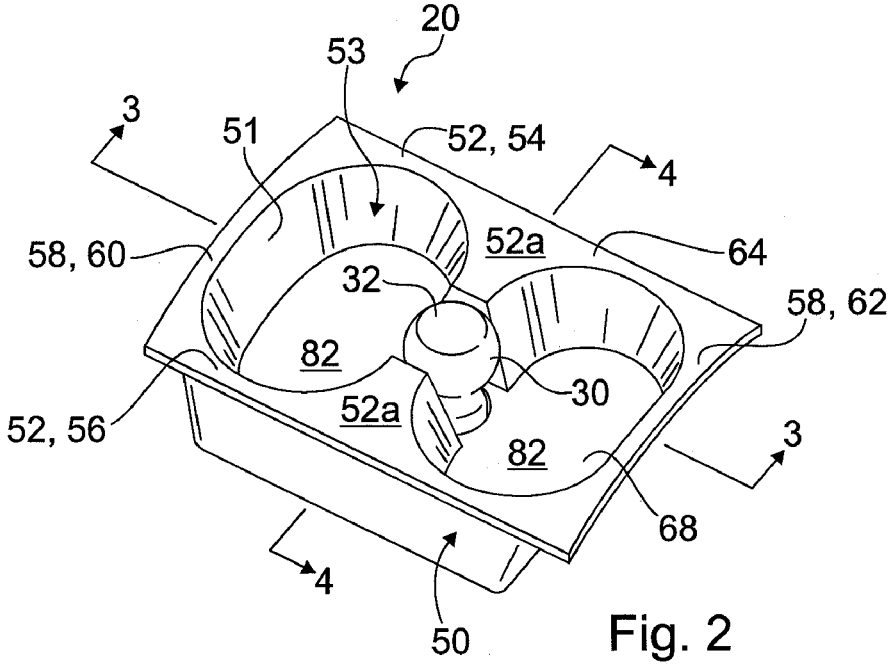
FIG. 2 is a detail perspective view of the first embodiment of the recessed lock actuator assembly of FIG. 1, illustrating the housing isolated from the door panel and the actuator mounted within the housing.

As shown in FIG. 2, the first embodiment of the lock actuator assembly 20 includes a rectangular housing 50 that includes a first pair of opposed side walls 52, including a first side wall 54 and a second side wall 56. In the depicted embodiment, each side wall 54, 56 of the first pair of side walls 52 includes an integrally formed blocking boss 52*a* extending inwardly to be in close proximity to, and to closely flank the actuator 30 on two opposite sides thereof. The provision of the blocking bosses 52*a* on two sides of the actuator 30 partially blocks access to the actuator, and makes it very difficult for an unauthorized person to wrap the end of a wire or similar theft tool around the actuator. As one non-limiting example, the spacing between the edge of the actuator 30 and the adjacent blocking boss 52*a* may be in a range of 0.5-1.0 millimeters.

The housing 50 also includes a second pair of opposed side walls 58, substantially transverse to the first pair of opposed side walls 52. The second pair of opposed side walls 58 includes a third sidewall 60 and a fourth sidewall 62.

Figure 8A:
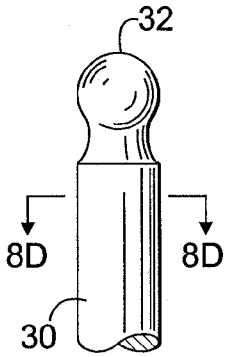
FIGS. 8(*a*)-8(*f*) illustrate examples of preferred actuator profiles and respective cross sectional actuator shapes.
Figure 8B:
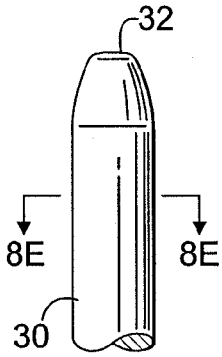
Figure 8C:
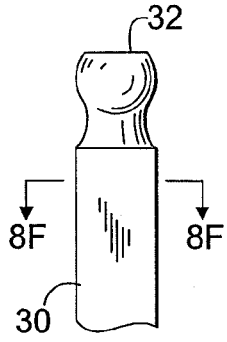
Figure 8D:
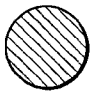
Figure 8E:
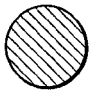
Figure 8F:
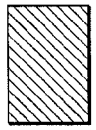

The actuator 30 includes an elongate body having an upper end 32, and a lower end 36 that is separated from the upper end 32 by an intermediate body portion 34. The intermediate body portion 34 of the actuator 30 is generally rod shaped, and is preferably circular or rectangular in section (FIGS. 8*d-f*). The actuator 30 may be provided with a central bore formed therein and having female threads to allow rotatable threaded installation of the actuator on a linkage rod (not shown).

The intermediate body portion 34 is preferably provided with shaping adjacent the upper end 32 so that the actuator 30 is easily gripped by the fingertips of the user. Examples of such shaping include, but are not limited to, tapering the intermediate body portion 34 to the upper end 32 (FIG. 8*b*), providing a smooth circumferential groove adjacent to, but spaced apart from the upper end 32 (FIGS. 8*a*, 8*c*), or providing an upper end 32 that is enlarged compared to the body portion 34 (FIGS. 5 and 6).

In the embodiment of FIGS. 1-4, the actuator 30 is movable in a direction that is orthogonal to the upper surface 64 of the housing 50 (FIGS. 3 and 4). However, it is within the scope of this invention to use an actuator 30 that is movable in a direction that is parallel to the upper surface 64 of the housing 50, or that is pivotable within the housing 50.

In the embodiment of FIGS. 1-4, the actuator 30 is centrally positioned within the housing 50 such that the blocking bosses 52*a* of the first pair of opposed side walls 52 abut and confront the actuator 30, and such that the second pair of opposed side walls 58 is spaced apart from the actuator 30. By positioning the blocking bosses 52*a* of the first pair of opposed side walls 52 in such close proximity to the actuator 30, a theft tool cannot easily encircle the body 34 of the actuator 30. However, by positioning the second pair of opposed side walls 58 at a suitably spaced distance from the actuator 30, a user is able to easily access and grasp the actuator 30 with his or her fingertips.

Further in the depicted embodiment, the housing 50 is formed with the hollow recess 53 formed in the upper side thereof. The recess 53 has an hourglass shape, such that only the blocking bosses 52*a* of the first pair of opposed side walls 52 abut and confront the actuator 30. The remaining portions of the first pair of opposed side walls 52 and the second pair of opposed side walls 58 are distanced from the actuator 30 to form a pair of relatively large voids 82 on opposed sides of the actuator 30, to receive the fingertips of a user therein.

Second Embodiment

A second embodiment of a lock actuator assembly 120 according to the present invention is disclosed in FIGS. 5-7. The lock actuator 120 is substantially similar to that of the first embodiment, except for the shapes of the housing 150 and the actuator 130. In the embodiment of FIGS. 5-7, the rectangular housing 150 is not provided with an hourglass-shaped recess, but instead, includes a recess 176 having a substantially rectangular outline shape.

The housing 150 includes a first pair of opposed side walls 152, including a first sidewall 154 and a second sidewall 156. The housing 150 also includes a second pair of opposed side walls 158, oriented perpendicularly to the first pair of opposed side walls 152. The second pair of opposed side walls 158 includes a third sidewall 160 and a fourth sidewall 162. The housing also includes a floor 168 having an opening 170 formed therethrough to accommodate passage of the actuator 130 therethrough.

The actuator 130 includes an elongate body having an upper end 132, and a lower end 136 that is separated from the upper end 132 by an intermediate body portion 134. The intermediate body portion 134 of the actuator 130 is generally rod-shaped, and is substantially rectangular in cross-section. The intermediate body portion 134 is provided with shaping tapering outwardly as it moves toward the upper end 132, so that the actuator 130 is easily gripped by the fingertips of the user.

The actuator 130 depicted in FIGS. 5-7 is movable in a direction that is normal to upper surface 164 of the housing 150. However, it is within the scope of this invention to use an actuator 130 that is movable in a direction that is parallel to the upper surface of the housing 164, or that is pivotable within the housing 150.

In the embodiment shown in FIGS. 5-7, the actuator 130 is centrally positioned within the housing 150, and is provided having an expanded width, substantially filling the space between the side walls 154, 156 in the central portion of the recess 176, such that it is closely spaced therebetween. For example, the central portion 152*a* of each side wall of the first pair of opposed side walls 152 abuts and confronts the actuator 130, because of the closeness of the actuator thereto.

As one non-limiting example, the spacing between the edge of the actuator 130 and the adjacent side wall 152 may be in a range of 0.5-1.0 millimeters.

The remaining portions of the first pair of opposed side walls 152 and the second pair of opposed side walls 158 are spaced apart from the actuator 130.

As noted above, by positioning the actuator body 134 in such close proximity to the central portion 152*a* of the first pair of opposed side walls 152, a wire loop, or similar theft tool cannot easily encircle the body 134 of the actuator 130. However, by positioning the second pair of opposed side walls 158 at a spaced distance from the actuator 130, the user is able to easily access and grasp the actuator 130 with his or her fingertips within the recess 176.

Third Embodiment

Figure 9A:
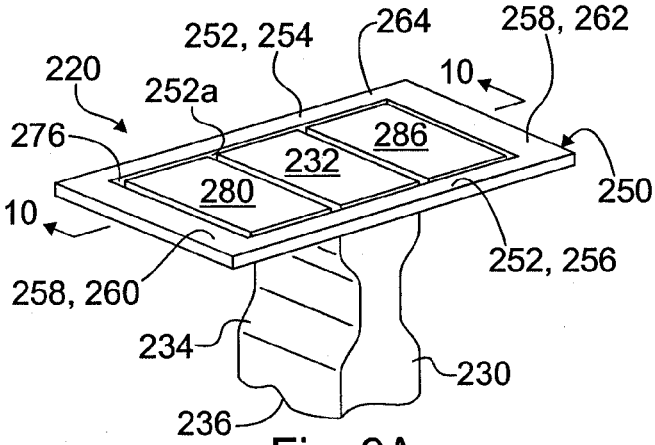
FIG. 9A is a perspective view of a third embodiment of the recessed lock actuator assembly illustrating pivotable panels mounted to the side walls and oriented to be coplanar with the upper surface of the housing and with the upper edge of the actuator, shown in the locked position.
Figure 9B:
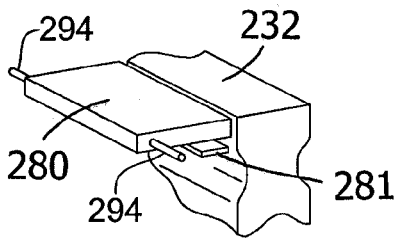
FIG. 9B is a detail perspective view, partly cut away, of a portion of the lock actuator assembly of FIG. 9A.
Figure 10:
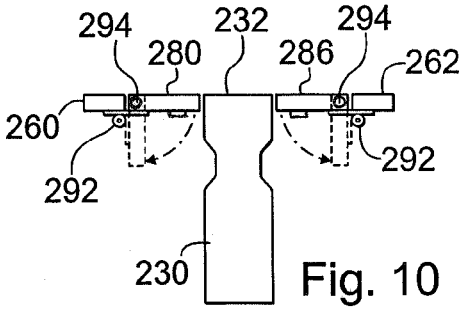
FIG. 10 is a side sectional view of the third embodiment of a recessed lock actuator assembly as seen across line 10-10 of FIG. 9 illustrating the normal coplanar position of the panels, and also illustrating in broken the pivoted position of the panels.

A lock actuator assembly 220 according to a third embodiment of the invention is shown in FIGS. 9 and 10. The lock actuator assembly 220 according to the third embodiment is similar to that of the second embodiment, and includes additional theft prevention features. It will be understood that unless specifically described as different herein, the actuator assembly 220 according to the third embodiment is substantially similar to the actuator assembly 120 according to the second embodiment, as previously described.

The lock actuator assembly 220 of FIGS. 9-10 includes an actuator 230 and a recessed housing 250. The housing 250 includes a recess 276 having a substantially rectangular outline shape. The housing 250 includes a first pair of opposed side walls 252, including a first sidewall 254 and a second sidewall 256. The housing 250 also includes a second pair of opposed side walls 258 oriented perpendicularly to the first pair of opposed side walls 252. The second pair of opposed side walls 258 includes a third sidewall 260 and a fourth sidewall 262.

The actuator 230 includes an elongate body having an upper end 232, and a lower end 236 that is separated from the upper end 232 by an intermediate body portion 234. The intermediate body portion 234 of the actuator 230 is generally rod shaped, and is preferably rectangular in section. The intermediate body portion 234 is provided with shaping adjacent the upper end 232 thereof, so that the actuator 230 is easily gripped by the fingertips of the user. The actuator 230 of FIGS. 9-10 is movable in a direction that is normal to upper surface 264 of the housing 250.

In the third embodiment, the actuator 230 is centrally positioned within the housing 250, and is provided in a width such that it extends between the first pair of opposed side walls 252 so as to substantially fill the space therebetween in a central portion 252*a* thereof. For example, the central portion 252*a* of the first pair of opposed side walls 252 abuts and confronts the actuator 230, and the remaining portions of the first pair of opposed side walls 252 and the second pair of opposed side walls 258 are spaced apart from the actuator 230.

The housing 250 is provided with two pivotable panels 280, 286 which extend between the second pair of opposed side walls 258 and the actuator 230. The panels 280, 286 are sized to fill the space between the respective side walls 260, 262 and the actuator 230. The panels 280, 286 lie generally within the plane defined by the upper end 264 of the housing 250, so that the upper end 264 of the housing 250, the upper end 232 of the actuator 230, and the panels 280, 286 form a generally continuous surface, when the actuator 230 is in its locked position.

The first panel 280 is pivotally secured to the housing 250 using a pivot pin 294. The first panel 280 is secured along one edge to the third sidewall 260 adjacent the upper end 264. The opposing edge of the first panel 280 abuts a lateral face of the actuator 230. The first panel 280 is maintained within the plane defined by the upper end 264 of housing 250 using a biasing spring. For example, FIG. 10 illustrates a torsion spring 292 extending between the first panel 280 and the sidewall 260. The first panel 280 may include an integrally molded stop tab 281 (FIG. 9B) to limit its upward travel relative to the housing 250.

In exactly the same manner as described for the first panel 280, but in a mirror-image configuration, the second panel 286 is pivotally secured to the housing 250 using a pivot pin 294. The second panel 286 is secured along one edge to the fourth sidewall 262 adjacent the upper end 264. The opposing edge of the second panel 286 abuts a lateral face of the actuator 230. The second panel 286 is maintained within the plane defined by the upper end 264 of the housing 250 using a biasing member such as a torsion spring 292.

By providing panels 280, 286 within the housing 250 positioned relative to the side walls and the actuator 230 to form a generally continuous surface, a theft tool is prevented from encircling the body 234 of the actuator 230. The torsion springs 292 are selected to allow easy displacement of the panels 280, 286 when urged downward using the fingertips, allowing the fingertips to access and grasp the body 234 of the actuator 230. Upon removal of the fingertips, the panels 280, 286 return to the horizontal position as urged by the torsion spring 292.

Fourth Embodiment

A lock actuator assembly 320 according to a fourth embodiment of the invention is shown in FIGS. 11-14. In this embodiment, the lock actuator assembly 320 includes a housing 350, and an actuator 330 slidably disposed in the housing.

Figure 12:
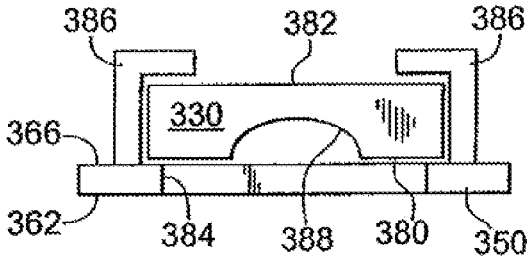
FIG. 12 is a top sectional view of the fourth embodiment of the recessed lock actuator assembly as seen across line 12-12 of FIG. 11.
Figure 13:
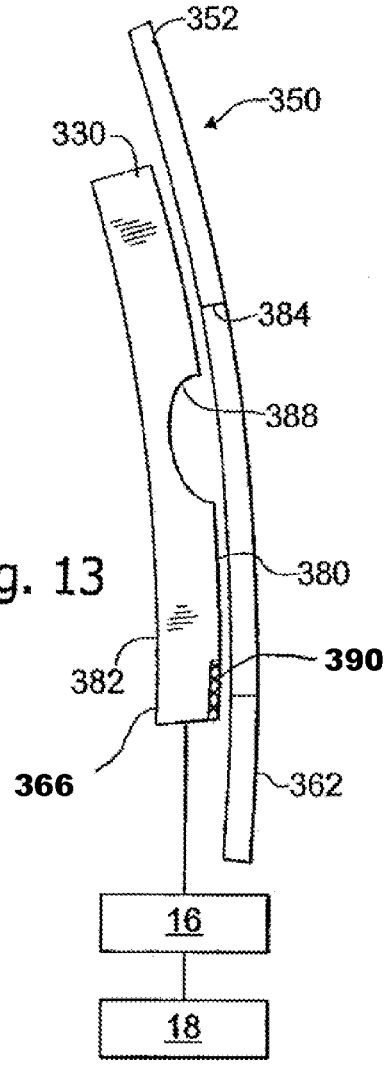
FIG. 13 is a side sectional view of the fourth embodiment of the recessed lock actuator assembly as seen across line 13-13 of FIG. 11.

The housing 350 includes a face plate 352 having a front face 362 and a rear face 366. The housing 350 also includes a pair of integral brackets 386, 386 attached to, and extending rearwardly from the rear face 366 of the face plate 352. The brackets 386, 386 are formed with a substantially L-shaped cross section, as shown in FIG. 12. The actuator 330 fits slidably between the brackets 386, 386. Additionally, a lower end of the actuator 330 is operatively connected to a linkage of the vehicle door locking mechanism (FIG. 13). The actuator 330 is also operatively connected to an electronically operable solenoid 16, to enable power door lock operation.

Figure 11:
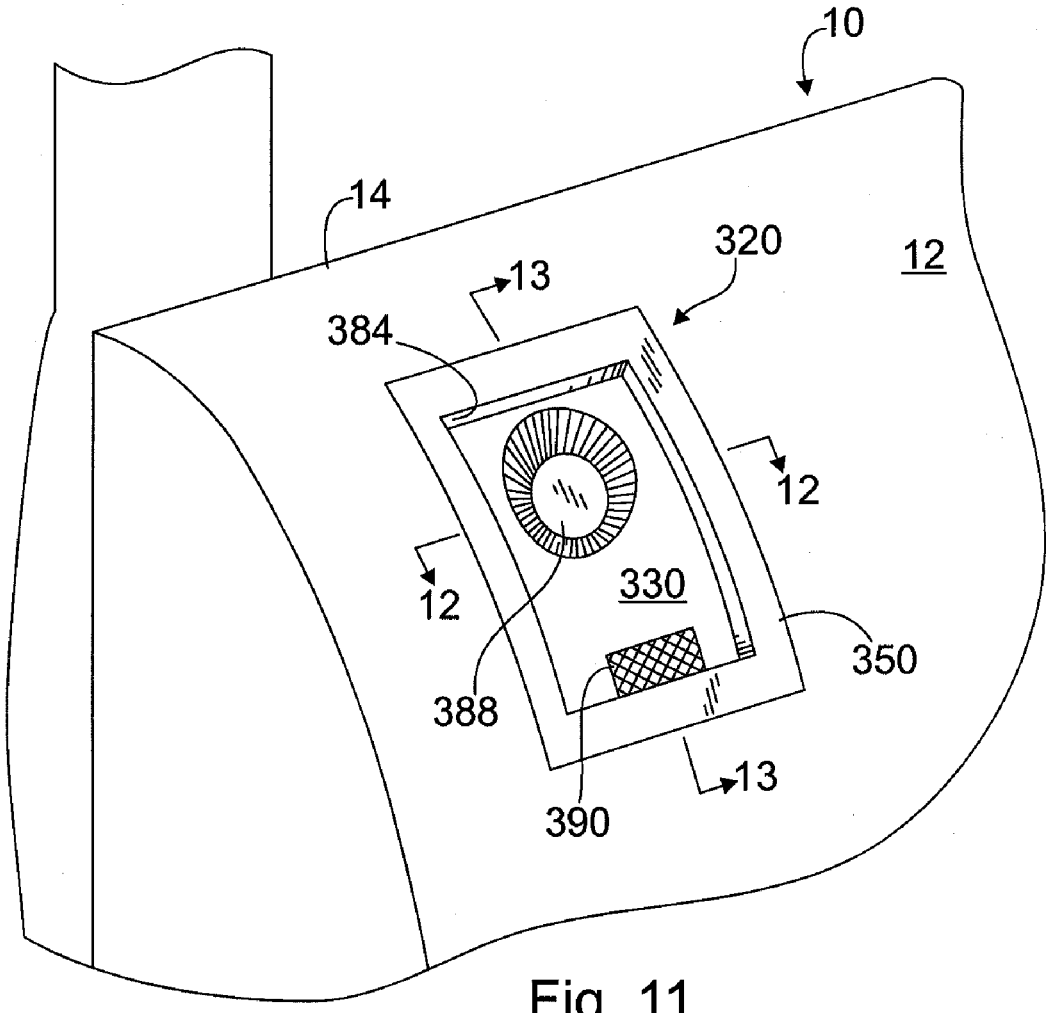
FIG. 11 is a front perspective view, partially cut away, of an interior door panel for a vehicle illustrating the fourth embodiment of the recessed lock actuator mounted within the door sill, illustrating the depression which allows a single fingertip to grip the actuator, and also illustrates the position indicator.

Although the housing 350 illustrated in FIGS. 11-14 is shown as having a rectangular peripheral shape, it is within the scope of this invention to form the housing 350 having alternative closed peripheral shapes, including, but not limited to, a curvilinear shape. The housing 350 may be formed to lie in a slightly curved plane, as shown in FIGS. 11 and 13, or be formed to lie in a flat plane.

The housing 350 includes a central opening 384 which provides access to the actuator 330, which is located behind the face plate 352 and between the brackets 386, 386. In the embodiment shown in FIGS. 11-14, the central opening 384 is provided having the same peripheral rectangular shape as the housing 350.

The actuator 330 includes a relatively thin actuator plate, having a similar shape to the shape defined by the housing 350. For example, in the illustrative example, both the actuator 330 and the housing 350 lie in curved planes. The actuator 330 is slidably secured to the underside of the housing 350 such that the second plane defined by the actuator 330 lies parallel to the first plane defined by the housing 350. The actuator 330 moves between a first, locked position in which the locking mechanism is locked, and a second, unlocked position in which the locking mechanism is unlocked. The actuator 330 slides relative to the housing 350 such that the first plane remains generally parallel to the second plane. In FIG. 11, the actuator 350 is shown in the unlocked position thereof.

Figure 14:
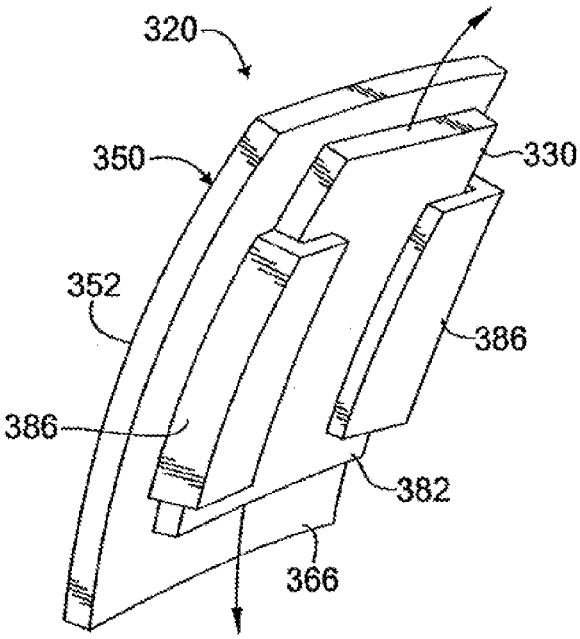
FIG. 14 is a rear perspective view of the fourth embodiment of the recessed lock actuator assembly of FIG. 11, illustrating the actuator slidably mounted to the underside of the housing, and with a direction of motion of the actuator, relative to the housing, indicated by arrows.

The actuator 330 has a front face 380, and a rear face 382 which is opposed to the front face 380. The front face 380 includes a concavity or depression 388 sized and shaped to receive the fingertip of a user therein. The concavity 388 may be formed having a circular shape, as shown in FIGS. 12-14, or may alternatively be formed having closed shapes which are polygonal or irregular.

The front face 380 of the actuator 330 also includes a position indicator 390, that allows the occupant to visually determine whether or not the vehicle door lock is engaged. For example, the position indicator 390 may be seen by the occupant when the actuator 330 is in the unlocked position, but is visually obscured by the housing 350 when the actuator 330 is in the locked position.

In the embodiment, of FIGS. 11-14, the position indicator 390 includes a contrasting insert positioned adjacent to an edge of the front face 380. This edge is selected so as to correspond to the leading, or following, edge of actuator 330 with respect to the motion of the actuator 330 within the housing 350. However, other structures may be used to indicate the position of the actuator 330 relative to the housing 350. For example, instead of an insert, the position indicator may consist of a small painted region positioned adjacent the leading, or following, edge on the front face 380 and would function identically to the insert.

The actuator 330 is slidably secured to the housing 350 using the brackets 386. The brackets 386 extend outwardly from the rear face 366 of the housing face plate 352, and surround a portion of the peripheral edge of one pair of opposed sides of the actuator 330. The brackets 386 extend around to cover a portion of the rear face 382. The actuator 330 is maintained in a desired position relative to the housing 350 using conventional structure. For example, the actuator 330 and housing 350 may be provided with strategically positioned interconnecting detents and protrusions, not shown, which act to maintain the relative positions of these structures, but which are easily displaced by applying a directional pressure within the concavity 388 using the fingertip.

Although the presently contemplated embodiments of a recessed lock actuator assembly have been described herein, the foregoing description is intended to illustrate, rather than to limit the invention. Those skilled in the art will recognize that various substitutions and modifications can be made, without departing from the scope of the invention. All such modifications, which are within the scope of the appended claims, are intended to be within the scope and spirit of the present invention.

What is claimed is:

1. An actuator assembly for actuation of a locking mechanism, the actuator assembly comprising: a housing comprising side walls arranged to form a closed section, said side walls having an upper edge defining a first plane, the housing comprising a face plate having a front face and a rear face, the housing further comprising a pair of substantially "L" shaped brackets having a top and bottom surface, integrally attached to the rear face of the housing face plate, an actuator comprising an actuator plate, said actuator plate having a front face, a rear face, an upper portion and defining a second plane, each "L" shaped bracket holding a side of the actuator and providing a sliding track for movement of the actuator within the brackets beyond said top and bottom surfaces, wherein the front face of said actuator plate has a concave depression formed therein to receive a fingertip of a user, and the housing brackets are configured to slidably support the actuator plate therebetween; wherein the actuator is slidably secured to the housing such that the actuator moves between a first position in which the locking mechanism is locked, and a second position in which the locking mechanism is unlocked, wherein the top of the actuator is disposed behind and adjacent the rear face of the housing face plate in both the first and second positions thereof, and wherein the actuator is slidably movable relative to the housing such that the second plane moves substantially parallel to said first plane.

2. An actuator assembly according to claim 1, wherein the first and second planes are substantially flat.

3. An actuator assembly according to claim 1, wherein each of said first and second planes has a curved shape.

4. An actuator assembly according to claim 1, wherein the concave depression of the actuator plate has one of circular, irregular and polygonal shape.

5. An actuator assembly according to claim 1, wherein said actuator plate includes a front face and a position indicator formed on the front face.

6. An actuator assembly according to claim 5, wherein the position indicator includes a contrasting insert disposed adjacent to an edge of the front face.

7. An actuator assembly according to claim 5, wherein when the actuator is in the first position, the position indicator does not underlie the housing and is viewable from above the housing, and when the actuator is in the second position, the position indicator underlies the housing and is not viewable from above the housing.

8. An actuator assembly adapted to permit either manual or power actuation of a vehicle door locking mechanism, the actuator assembly comprising: an actuator comprising an actuator plate having a from face and a rear face; a housing comprising a pair of substantially "L" shaped brackets having a top and bottom surface, the housing comprising a face plate having a front face and a rear face; said pair of brackets integrally attached to the rear face of the housing face plate, the brackets extending around to cover a portion of the rear face of the actuator and providing a sliding track for movement of the actuator within the brackets beyond said top and bottom surfaces; wherein the front face of said actuator plate has a concave depression formed therein to receive a fingertip of a user, and the housing brackets are configured to slidably support the actuator plate therebetween; and a solenoid disposed below the housing and operatively attached to said actuator; wherein said solenoid is operable to move the actuator substantially vertically between a locked position in which the locking mechanism is locked, and an unlocked position in which the locking mechanism is unlocked; wherein the top of the actuator plate is disposed behind and adjacent the rear face of the housing face plate in both the locked and unlocked positions thereof; and wherein the housing defines a first plane and the actuator plate defines a second plane; and wherein profiles of the first plane and the second plane are substantially parallel to each other.

9. An actuator according to claim 8, wherein the housing comprises side walls arranged to form a closed section, and an upper edge of the side walls defines said first plane, wherein the actuator plate is slidably secured to an underside portion of the housing such that the actuator plate slides between the locked position and the unlocked position, and the actuator plate is operable to slide relative to the housing such that the second plane moves substantially parallel to said first plane.

10. An actuator assembly according to claim 8, wherein said profiles of the first and second planes, respectively, are either flat or curved in shape.

11. An actuator assembly according to claim 8, wherein said concave depression of the actuator plate has one of circular, irregular and polygonal shape.

12. An actuator assembly according to claim 8, wherein said actuator plate includes a position indicator formed on front face thereof; and wherein when the actuator is in the unlocked position, the position indicator does not underlie the housing and is viewable from above the housing, and when the actuator is in the locked position, the position indicator underlies the housing and is not viewable from above the housing.

13. An actuator assembly according to claim 12, wherein the position indicator includes a contrasting insert disposed adjacent to an edge of the front face.

* * * * *